US008272908B2

(12) United States Patent
Warmuth-Rued

(10) Patent No.: US 8,272,908 B2
(45) Date of Patent: Sep. 25, 2012

(54) SWIM RING AND SWIMMING AID

(75) Inventor: Michaela Warmuth-Rued, Augsburg (DE)

(73) Assignee: Freds Swim Academy GmbH, Augsburg (DE)

( * ) Notice: Subject to any disclaimer, the term of this patent is extended or adjusted under 35 U.S.C. 154(b) by 177 days.

(21) Appl. No.: 12/807,497

(22) Filed: Sep. 7, 2010

(65) Prior Publication Data

US 2012/0015571 A1 Jan. 19, 2012

(30) Foreign Application Priority Data

Jul. 16, 2010 (EP) ..... 10007391

(51) Int. Cl.
*B63C 9/08* (2006.01)
*B63C 9/28* (2006.01)

(52) U.S. Cl. ..... 441/129

(58) Field of Classification Search ..... 441/80–83, 441/87–101, 106, 108, 111–119, 121–123, 441/125–132
See application file for complete search history.

(56) References Cited

U.S. PATENT DOCUMENTS 2,173,567 A * 9/1939 Shafer ..... 441/93
4,523,913 A * 6/1985 Kaino ..... 441/81

FOREIGN PATENT DOCUMENTS

DE 199 36 736 A1 2/2001

* cited by examiner

*Primary Examiner* — Daniel Venne
(74) *Attorney, Agent, or Firm* — Von Rohrscheidt Patents

(57) ABSTRACT

A swim ring, including: at least one ring stabilizing a swim position of the swim ring; wings protruding upward from a base component or from the ring and configured with disengageable wing connectors; and suspenders configured to be attached on one side at the base component or at the ring and on the other side at the wings, wherein the ends of the suspenders are configured to be connected to the wings through disengageable suspender connectors, wherein a wing side suspender connector and a wing connector of a first wing are integrally combined to form a combined one piece wing side connector, wherein the combined one piece wing side connector, a suspender side suspender connector and a wing connector of a second wing are configured, so that establishing disengageable connections of the connectors with one another is only possible in a single connection configuration.

19 Claims, 3 Drawing Sheets

SWIM RING AND SWIMMING AID

RELATED APPLICATIONS

This patent application claims priority from and incorporates by reference European patent application EP 10007391 filed on Jul. 16, 2010.

FIELD OF THE INVENTION

The invention relates to a swim ring configured as a swimming aid for swimming students to learn how to swim including at least one ring stabilizing the swimming position of the swim ring, a base component attached to the ring and bridging the ring, wherein the base component is provided for supporting a chest portion of a swim student, wings protruding from the base component or from the ring in upward direction and including wing connection devices configured to connect the ends of the wings with one another behind a back of the swim student and including a wing connector attached to an end of a first wing and a wing connector attached at an end of a second wing, suspenders configured to be attached on one side at the base component or at the ring and on the other side at the wings, wherein the suspenders extend like pant suspenders over the shoulders of the swim student, wherein the ends of the suspenders are configured to be attached at the wings through disengageable suspender connection devices which include at least one wing side suspender connector and at least one suspender side suspender connector according to the claimed swim ring configured as a swim aid for swim students for learning how to swim.

Swim rings of the type are used for supporting swim students preferably infants or toddlers in a stable, for example, forward inclined swimming position and to allow them to perform swimming movements with their arms and/or legs.

BACKGROUND OF THE INVENTION

A swim ring of this type is known from DE 199 36 736 A1. Thus, the wings are disposed below the armpits of the swim student and are provided with connection devices like plug in connectors at their free ends, wherein the wings are connectable and disengaged through the connection devices behind the back of the swim student. Furthermore two suspenders are configured to be connected in a disengageable manner on one side at the base component and on the other side at the free ends of the two wings through connection devices and the suspenders extend like pant suspenders in a cross over arrangement over the shoulder portion of the swim student. Therefore on the one hand side the free ends of the suspenders have to be attached in a disengageable manner at the free ends of the wings and on the other hand side the free ends of the wings have to be configured to be connected to one another in a disengageable manner. Overall therefore the user has to establish at least 3 connections (wing-wing, suspender 1-wing, suspender 2-wing). Thus, it can happen that the users are unaware in which arrangement or orientation the suspenders (in parallel or crossed over) are to be attached at the wings or which end pieces of the disengageable connection belong together. Therefore on the one hand the operator comfort of the known swim ring is not very high. On the other hand it cannot be excluded that the position of the swim student, often infants and toddlers, is not sufficiently secured through the connection that is not established correctly.

BRIEF SUMMARY OF THE INVENTION

Thus it is the object of the present invention to improve a swim ring as recited supra, so that it has higher operator comfort and higher operator safety. This is accomplished according to the invention through a swim ring configured as a swim aid for swim students for learning how to swim, including at least one ring stabilizing a swim position of the swim ring, a base component attached to the ring and bridging the ring, wherein the base component is configured to support a chest portion of a swim student, wings protruding upward from the base component or from the ring and configured with disengageable wing connectors configured to connect ends of the wings with one another behind a back of the swim student and including a wing connector attached to an end of a first wing and a wing connector attached at an end of a second wing, and suspenders configured to be attached on one side at the base component or at the ring and on the other side at the wings, wherein the suspenders extend like pant suspenders over shoulders of the swim student. The ends of the suspenders are configured to be connected to the wings through disengageable suspender connectors, which include at least one wing side suspender connector and at least one suspender side suspender connector. The suspenders are attached at their wing side ends at the at least one suspender side suspender connector and the wing side suspender connector and the wing connector of the first wing are integrally combined to form a combined one piece wing side connector to which the wing connector of the second wing and also the at least one suspender side connector are respectively connectable in a disengageable manner. The combined one piece wing side connector, the suspender side suspender connector and the wing connector of the second wing are configured, so that establishing disengageable connections of the connectors with one another is only possible in a single connection configuration.

It is proposed according to the invention that the suspenders with their wing side ends are connected at a joint suspender side suspender connector, the wing side suspender connector is integrated with the wing connector of the first wing to form a combined wing side connector, wherein the wing connector of the second wing and also the common suspender side suspender connector are respectively configured to be connected with the combined wing side connector in a disengageable manner. The combined wing side connector, the suspender side suspender connector and the wing connector o f the second wing are configured, so that establishing disengageable connections of these connector amongst one another is only possible for a single configuration of the connection.

In this single connection configuration the joint suspender side suspender connector is connected with the wing side suspender connector and the wing connector of the first wing is connected with the wing connector of the second wing. It has become apparent that cross over suspenders are less favorable from an ergonomic point of view. Thus, the invention effectively excludes on the one hand that the suspenders are connected with the wings when the suspenders are crossed over one another. Furthermore it is assured through the invention that the swim ring is exclusively used in the desired connection configuration of suspenders and wings, not at least because when a connection is not established, a wing or a suspender will hang loose and will clearly make it impossible to use the swim ring. Since the desired connection configuration of wings and suspenders assured by the invention is simultaneously the safest operationally, the invention advantageously improves the operating safety for the swim ring.

Furthermore, the measure according to the invention provides a self evident use of the swim ring since a user in view of the connectors configured according to the invention quickly realizes that the suspenders with the wings and the wings amongst one another can only be connected in a single manner. Further advantageous embodiments and improvements of the invention are provided through the measures recited in the below list (the measures may be taken alone or in any suitable combination):

- the suspender connectors and the wing connectors are formed by quick connectors like plug-in connectors and/or zip fasteners and/or hook and loop fasteners and/or buttons interacting with button holes;
- the suspender connectors and the wing connectors are respectively formed by plug-in connectors;
- the suspender side suspender connector, the wing connector of the second wing and the combined one piece wing side connector include at least one male plug and at least one female plug receiver, and the plugs and the plug receivers are configured with different geometries, so that all plug connections between the plugs and the plug receivers can only be established in a single connection configuration;
- the suspender side suspender connector includes at least one male plug, the wing connector of the second wing includes at least one additional male plug and the combined one piece wing side connector includes at least two female plug receivers;
- a male plug includes an engagement lug which is deformable upon insertion of the male plug into a female plug receiver and wherein the engagement lug reaches behind a retaining edge of a recess in the female plug receiver in a elastic manner in a completely inserted end position of the male plug in the female plug receiver;
- the combined one piece wing side connector includes at least two female plug receivers, a female plug receiver and a male plug, or two male plugs;
- the at least one suspender side suspender connector includes at least one loop through which the ends of the suspenders are looped;
- the wing connector of the second wing includes at least one loop through which an end of the second wing is looped;
- the combined one piece wing side connector includes at least one loop through which an end of the first wing is looped;
- the combined one piece wing side connector is attached to the right wing viewed in swimming direction from above; and
- an insertion direction of the wing side suspender connector is disposed at the combined one piece wing side connector parallel to a swim direction and an insertion direction of the wing connector of the second wing is disposed perpendicular to the swim direction.

For example the suspender connection devices and the wing connection devices are connected through quick connectors like plug in connectors, zip fasteners, hook and loop fasteners, or by buttons interacting with button holes, particularly advantageous through plug in connectors.

Particularly advantageous, the suspender side suspender connector, the wing connector, and the combined wing side connector include at least one male plug and at least one female plug receiver, wherein the plugs and the plug receivers are geometrically configured differently, so that all plug in connections between plugs and plug receivers can only be established in the single connection configuration. A different geometric configuration means, for example, different lengths and/or widths and/or different cross sections of the plugs and plug receivers.

According to a particularly advantageous embodiment the suspender side suspender connector includes at least one male plug, the wing connector of the second wing includes at least one additional male plug and the combined wing side connector component includes at least two female plug receivers.

A male plug includes, for example, a catch lug which is configured to be deformed when inserted into a female plug receiver, wherein the catch lug reaches behind a retaining edge of a recess in a resilient manner when the plug is completely inserted into an end position in a recess of the plug receiver. Also the geometry of the engagement lugs of the plugs or of the recesses of the plug receivers can be configured differently in order to facilitate plug connections in the only one connection configuration.

In a further advantageous manner the wing side connector includes at least two female plug receivers, a female plug receiver and a male plug or 2 male plugs. Thus, the combined wing side connector is advantageously configured as an integral component in particular as an injection molded component made from plastic material.

Furthermore the end of the first wing forms a loop which engages a loop of the combined wing side connector. This loop is advantageously also integrally formed at the integral combined wing side connector, in particular through an injection molding method. This advantageously leads to a reduction of the components of the swim ring.

Particularly ergonomic operations of the swim ring for right handed persons is achieved when the combined wing side connector is attached to the right wing in swimming direction in top view. Thus, in this case, for example, an engagement lug of the plug of the left wing can be pressed down with the thumb of the right hand in order to disengage the interlocked plug in connection while the left hand pulls the plug from the associated plug receiver of the combined wing side connector. For depressing and disengaging an interlocked engagement lug typically more dexterity is required than for pulling a plug out. Therefore, the measure improves operator ergonomics for the swim ring for right handed persons.

In a particularly advantageous manner the wing side suspender connector is disposed parallel to the swimming direction in the combined wing side connector and the wing connector of the first wing is disposed in the combined wing side connector perpendicular to the swimming direction. This also helps to exclude mixed up connections because the different connection directions predetermine the connection logics.

BRIEF DESCRIPTION OF THE DRAWINGS

An exemplary embodiment of the invention is subsequently described in more detail with reference to drawing figures, wherein.

DETAILED DESCRIPTION OF THE INVENTION

Figure 1:
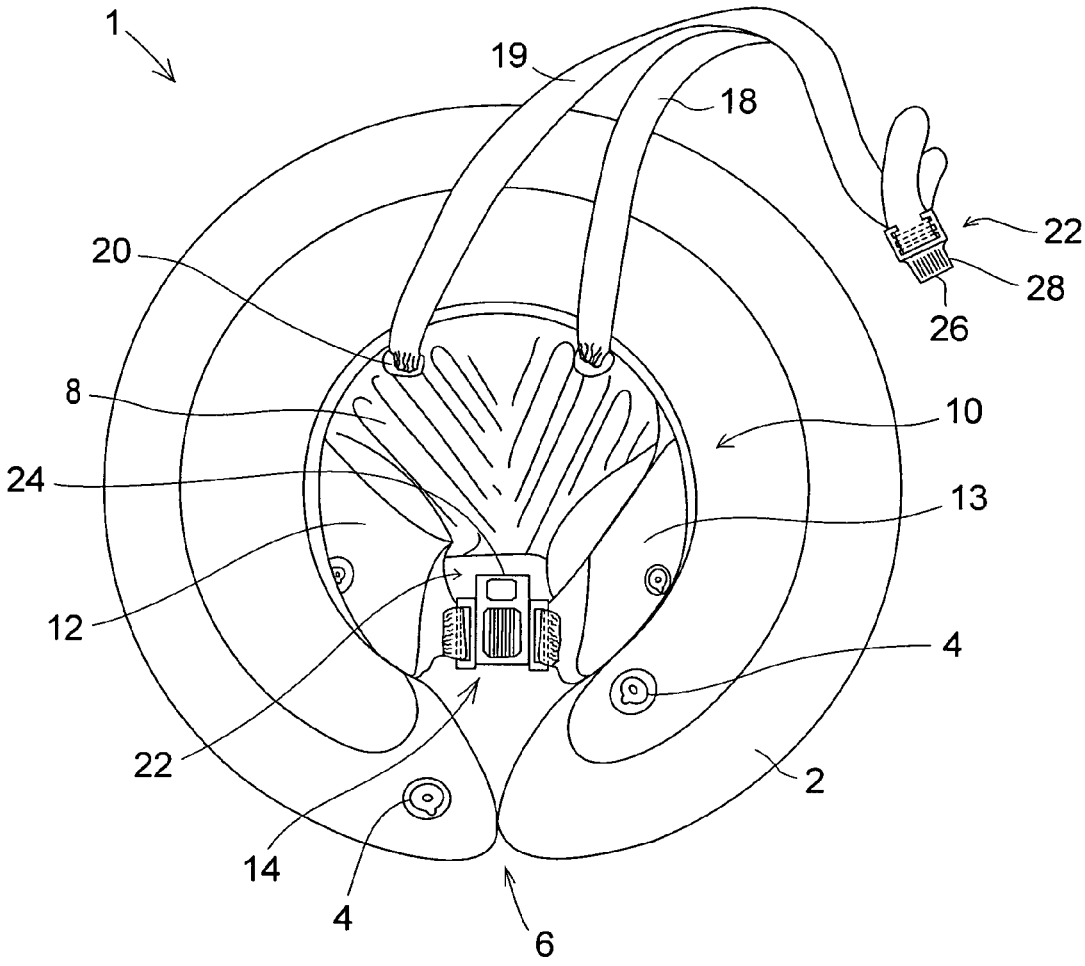
FIG. 1 illustrates a top view of a swim ring according to an exemplary embodiment of the invention.

FIG. 1 illustrates a swim ring 1 according to an exemplary embodiment of the invention which is configured as a swim aid for swimming students for learning how to swim.

The swim ring 1 includes, for example, an inflatable ring 2 stabilizing the swimming position of the swim ring wherein the ring includes air supply and -outlet openings which are configured to be closed through a valve body. The ring 2 has a section point 6 in the back, so that it is open in the back and can be bent open in an inflated condition and can be placed around the upper body of a swim student in the bent open condition. The ring 2 advantageously has two separately inflatable air chambers which can be filled with air or emptied independently from one another through air supply and outlet openings 4. The wall of the ring 2 is advantageously made from plastic material and may include reinforcement material.

A base component 8 is attached at the ring 2, wherein the base component bridges the ring at a base of the ring, e.g. in that the base component 8 is welded to the ring through a weld along an inner circumference of the ring 2. The base component 8 is provided for supporting a chest portion of a swim student and extends, for example, according to an advantageously swimming condition downward at a slant angle, viewed from the front to the back, towards the separation location 6. In the back means with reference to the swimming position of the swim student pointing towards his legs.

Figure 2:
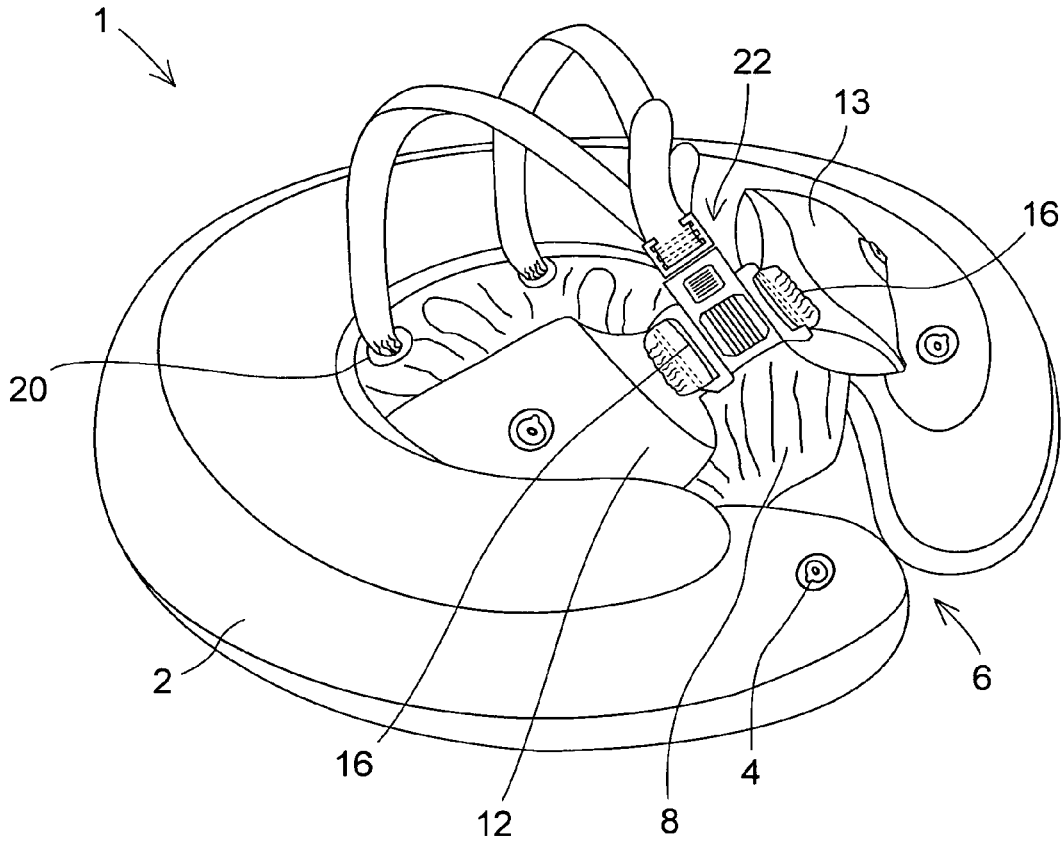
FIG. 2 illustrates a perspective view of the swim ring according to FIG. 1.

The base component 8 is advantageously also inflatable and for this purpose includes an air supply and outlet opening of its own which is not visible in the views of FIG. 1 and FIG. 2 and which is also configured to be closed by a valve element. Thus, the base component 8 is configured to be inflated and deflated independently from the ring 2. The base component 8 which is advantageously configured integral with the ring 2 through the weld can include plural air chambers of its own.

Furthermore wings 12, 13 are provided on the left and on the right of a ring opening 10, wherein the wings can be inflated separately from the base component 8 and protrude upward in swimming direction and are then disposed in the portion below the armpits of the swim student. The walls of the hollow wings 12, 13 and of the hollow base component 8 are advantageously made from plastic material and may include reinforcement material.

Figure 3:
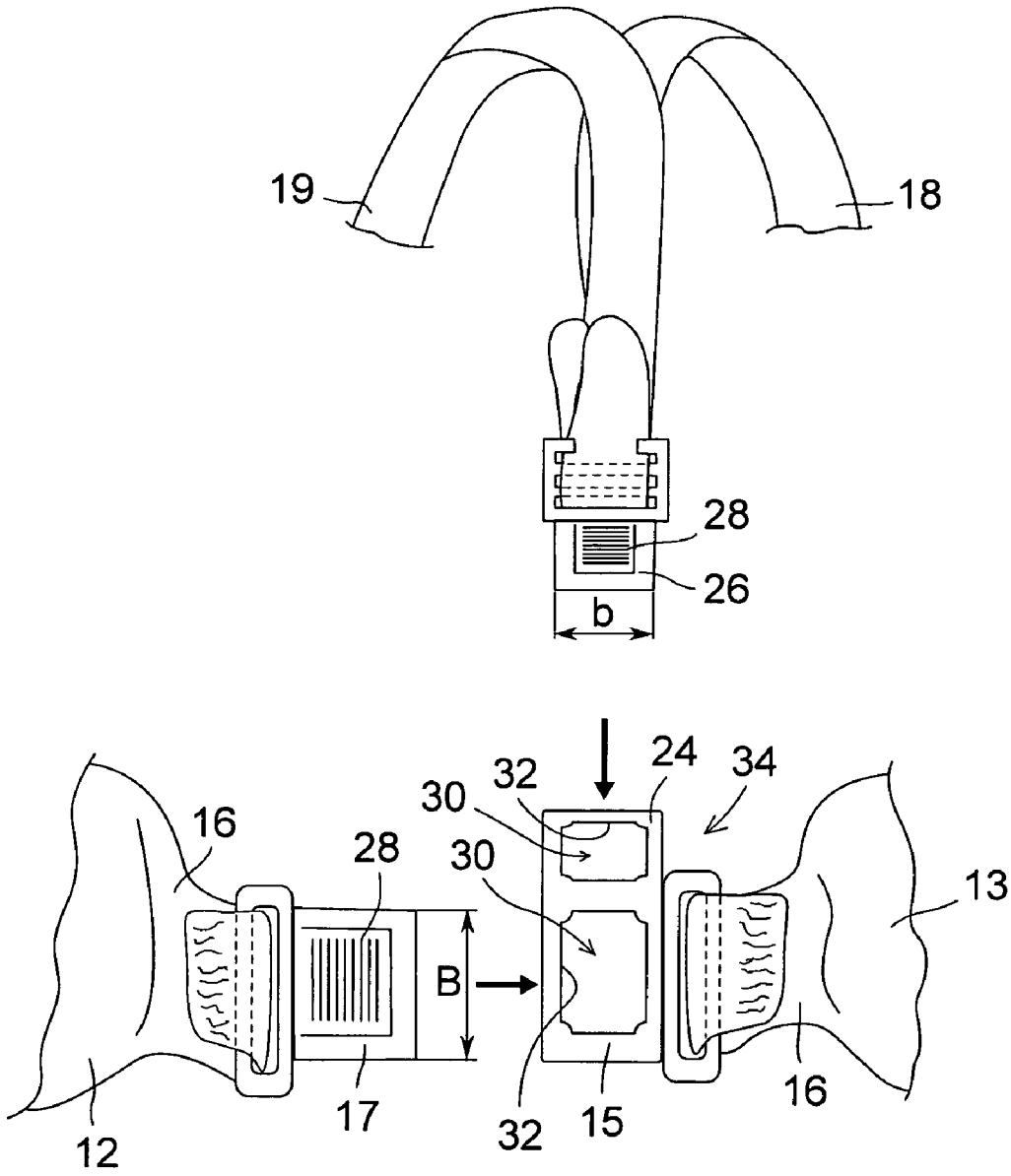
FIG. 3 illustrates a top view of disengageable connections of suspenders and wings of the swim ring according to FIGS. 1 and 2 according to an exemplary embodiment.

The wings 12, 13 represent body adaptation components and include wing connection devices 14 through which the free ends of the wings 12, 13 are connectable with one another behind the back of the swim student in a disengageable manner. The wing connection devices 14 include a wing connector 15 attached at the end of the belt 16 disposed at the end of the right wing 13 and a wing connector 17 attached at the belt 16 disposed at the end of the left wing 12 (FIG. 3).

According to an exemplary embodiment the wing connection devices 14 are formed by a plug connector, wherein for example a male plug 17 is supported at the first belt 16 of the left wing 12 and a female plug receiver 15 is supported at the other belt 16 of the right wing 13, wherein the plug receiver is configured complementary to the plug 17. The connection between the ends of the belts 16 and the plug 17 or the plug receiver 15 is performed, for example, through loops, wherein respectively a loop of a belt engages a loop configured at the plug 17 or at the plug receiver 15 as evident best from FIG. 3. The ends of the initially open loops of the belts 16 are then inserted, for example, through the loops of the plug 17 or of the plug receiver 15 and then welded together.

When the plug 17 includes a engagement lug 28 which is configured to be deformed when inserted into the plug receiver 15 (cf. lower arrow in FIG. 3), wherein the engagement lug 28 reaches behind a retaining edge 32 of the recess 30 in a resilient elastic manner when the plug 17 is completely inserted into the recess 30 of the plug receiver 15, this implements a form locked and disengageable connection between the two wings 12, 13. This form locked connection of the wings 12, 13 through the wing connection devices 14 is established, for example, when the ring 2 is applied to the upper body of a swim student in an inflated condition and the position of the swim student shall be secured along the inclined base component 8 through the two wings 12, 13.

In order to secure the position of the swim student in the ring 2, furthermore on the one hand side attachable suspenders 18, 19 are advantageously provided at the base component 8 and on the free ends of the wings 12, 13, wherein the suspenders extend like pant suspenders over the shoulders of the swim student and advantageously do not cross over one another. Also these suspenders 18, 19 are used for maintaining the position or the swimming position of the swim student relative to the wing 2 and in particular relative to its base component 8 as constant as possible and in particular prevent unintentional disengagement of the swim student from the swim ring 1 or a change of the swim position. FIG. 1 illustrates the suspenders 18, 19 in a condition where they are disengaged from the wings 12, 13 and FIG. 2 illustrates a condition where they are connected with the wings 12.

The suspenders 18, 19 are implemented, for example, through a single plastic hose which is also inflatable and which extends through two openings 20 in the base component and which protrudes with both its free ends respectively upward through the base component 8. Thus, a transversal component of the suspenders 18, 19 extends below the base component 8 and therefore is not visible in FIG. 1 and FIG. 2. Alternatively the suspenders 18, 19 can be configured separate and welded to the base component 8 or directly to the ring 2.

Configuring the suspenders 18, 19 as a single inflatable plastic hose has the advantage that only a single combined air inlet and outlet has to be provided. Furthermore this provides an elastic cushion which can on the one hand side contact the upper body of the swim student very well and one the other hand side due to the elasticity can also impart a certain pressure upon the upper body for stabilizing the swimming position. Alternatively a non-inflatable plastic strip can be used as a suspender 18, 19.

The free ends of the suspenders 18, 19 can be attached to the wings 12, 13 through disengageable suspender connector devices 22, wherein the wings advantageously include a wing side suspender connection component 24 and a suspender side connection component 26. The wing side connection component 24 is thus advantageously disposed at the belt 16 of the right wing 13. The wing side suspender connector 26 advantageously has two loops through which the ends of the suspenders 18, 19 are looped in a known manner for fixation. For the two suspenders 18, 19 thus advantageously a single and common suspender side suspender connector 26 is provided.

In a particularly advantageous manner the suspender connection devices 22 are also formed by disengageable plug in connectors, wherein the suspender side suspender connector 26 is, for example, formed by a male plug which is insertable in to a female plug receiver which forms the wing side suspender connector 24 as indicated in FIG. 3 through the upper arrow. The suspenders 18, 19 then form a pant suspender system together with the plug connectors 22, wherein the pant suspender system assures safe operations for the swim ring 1.

Thus, the wing side suspender connector 24 (plug receiver) with the wing connector 15 (plug receiver), for example, of the right wing 13 is integrally configured to form a combined wing side connector 34. The combined wing side connector 34 which advantageously includes two plug receivers 15, 24 is then connectable with the wing connector 17 (plug) of the left wing 12 and also with the common suspender side suspender connector 26, (plug) respectively to form a plug connection.

The common suspender side suspender connector 26 then includes at least a male plug, the wing connector 17 of the left wing 12 includes at least one additional male plug and the combined wing side connector 34 includes at least two female plug receivers 15, 24. Thus, the plug receivers 15, 24 and the plugs 17, 26 are configured geometrically different, so that all necessary plug connections between the plugs 17, 26 and the plug receivers 15, 24 are only facilitated when the plugs 17, 26 are insertable into the correct respectively associated plug receivers 15, 24.

In the present embodiment, for example, the width B of the plug 17 forming the wing connector of the left wing 12 is greater than the width b of the plug 26 forming the common suspender side suspender connector, so that the plug 17 connected to the left wing 12 can only be inserted into the associated plug receiver 15 of the combined wing side connector 34, wherein the plug receiver is adapted with respect to the larger width B of the plug 17, but so that the plug 17 cannot be inserted into the comparatively narrower plug receiver 24 which forms the wing side suspender connector.

Only in the single connection configuration illustrated in FIG. 3 the joint suspender side suspender connector 26 (plug with width b) is configured to be connected with the wing side suspender connector 24 (plug receiver) and the wing connector 17 (plug) of the left wing 12 is connectable with the wing connector 15 (plug receiver) of the right wing 13. Otherwise one of the two connections would not be possible, for example, an insertion of the plug 17 of the left wing 12 with the width B into the narrow plug receiver 24 for the plug 26 of the suspenders 18, 19 with the comparatively smaller width b.

The plug receiver 15 and the plug receiver 24 are then configured in the combined wing side connector 34 which is advantageously configured as an integral one piece component. At this combined wing side connector component 34 the plug receiver 24 forming the wing side suspender connector is disposed respectively viewed in the direction of the plug connection perpendicular to the plug receiver 15 forming the wing connector, so that the plug receiver 24 forming the wing side suspender connector is disposed parallel to the swimming direction and the plug receiver forming the wing connector is disposed perpendicular to the swimming direction. This also helps to exclude mixed up plug connections, because the different plug connection directions which are symbolized in FIG. 3 through the arrows predetermine the logic of the connection.

Alternatively certainly any plug/plug receiver combinations are feasible. For example the combined wing side connector 34 can also include two male connectors or a female plug receiver and a male plug instead of two female plug receivers 15, 24, wherein the associated plug-in partner at the suspenders 18, 19 or at the left wing 12 has to have the respective opposite gender.

Like for the wing connecting devices 14 at the wings 18, 19, the common plug 26 attached at the ends of the suspenders 18, 19 includes an engagement lug 28 which can be deformed when inserted into a complementary female plug receiver 24, wherein the engagement lug 28 reaches behind a retaining edge 22 of the recess 30 in an elastic resilient manner when the plug 26 is completely inserted into an end position in the recess 30 of the plug receiver 34. Thus, also a form locked and disengageable connection is provided between the suspenders 18, 19 and the wings 12, 13. By pressing the engagement lug 28 of a plug 17, 26 perpendicular to the lug plane into an unlocking position and subsequently pulling the plug 17, 26 out of the respective plug receiver 15, 24, such interlocked plug connections can be disengaged again.

Instead of the interlocked plug-in connections recited supra configured as disengageable connectors 14, 22, certainly also other disengageable connectors like zip lock connectors, hook and loop connectors or also buttons interacting with button holes can be used. However, it is a prerequisite that the suspender closure components 24, 26 on the one hand side and the wing closure components 15, 17 on the other hand side are geometrically configured in a different manner, so that the connection of the suspenders 18, 19 and of the wings 12, 13 can only be established in the described single connection configuration.

REFERENCE NUMERALS AND DESIGNATIONS

1 swim ring
2 ring
4 air supply and -outlet opening
6 parting point
8 base component
10 ring opening
12 second wing
13 first wing
14 wing connector
15 wing connector
16 belt
17 wing connector
18 suspender
19 suspender
20 openings
22 suspender connectors
24 wing side suspender connector
26 suspender side suspender connector
28 engagement lug
30 recess
32 retaining edge
34 combined one piece wing side connector

What is claimed is:

1. A swim ring and swim aid for swim students for learning how to swim, comprising:

at least one ring stabilizing a swim position of a swim ring;

a base component attached to the at least one ring and bridging the at least one ring, wherein the base component supports a chest portion of a swim student;

wings protruding upward from the base component or from the at least one ring and including disengageable wing connectors connecting ends of the wings with one another behind a back of the swim student and including a wing connector attached to an end of a first wing and a wing connector attached at an end of a second wing; and suspenders that are attachable on a first side at the base component or at the ring and on a second side at the wings, wherein the suspenders extend over shoulders of the swim student, wherein ends of the suspenders are connectable to the wings through disengageable suspender connectors, which include at least one wing side suspender connector and at least one suspender side suspender connector, wherein the suspenders are attached at wing side ends of the suspenders at the at least one suspender side suspender connector, wherein the at least one wing side suspender connector and the wing connector of the first wing are integrally combined to form a combined one piece wing side connector to which the wing connector of the second wing and also the at least one suspender side connector are respectively connectable in a disengageable manner, and wherein the combined one piece wing side connector, the at least one suspender side suspender connector and the wing connector of the second wing are connectable with one another only in one configuration.

2. The swim ring according to claim 1, wherein the suspender connectors and the wing connectors are quick connectors.

3. The swim ring according to claim 2, wherein the suspender connectors and the wing connectors are plug-in connectors.

4. The swim ring according to claim 3, wherein the at least one suspender side suspender connector, the wing connector of the second wing and the combined one piece wing side connector include at least one male plug and at least one female plug receiver, and wherein the at least one male plug and the at least one female plug receiver have different geometries, so that the at least one male plug and the at least one female plug receiver are only connectable in one connection arrangement.

5. The swim ring according to claim 4, wherein the at least one suspender side suspender connector includes at least one male plug, the wing connector of the second wing includes at least one additional male plug and the combined one piece wing side connector includes at least two female plug receivers.

6. The swim ring according to claim 4, wherein a male plug includes an engagement lug which is elastically deformable upon insertion of the male plug into a female plug receiver, and wherein the engagement lug extends behind a retaining edge of a recess in the female plug receiver in a completely inserted end position of the male plug in the female plug receiver.

7. The swim ring according to claim 4, wherein the combined one piece wing side connector includes at least two female plug receivers, a female plug receiver and a male plug, or two male plugs.

8. The swim ring according to claim 1, wherein the at least one suspender side suspender connector includes at least one loop through which the ends of the suspenders are looped.

9. The swim ring according to claim 1, wherein the wing connector of the second wing includes at least one loop through which an end of the second wing is looped.

10. The swim ring according to claim 1, wherein the combined one piece wing side connector includes at least one loop through which an end of the first wing is looped.

11. The swim ring according to claim 1, wherein the combined one piece wing side connector is attached to a right wing viewed in swimming direction from above.

12. The swim ring according to claim 1, wherein an insertion direction of the at least one wing side suspender connector is disposed at the combined one piece wing side connector parallel to a swim direction and an insertion direction of the wing connector of the second wing is disposed perpendicular to the swim direction.

13. The swim ring according to claim 2, wherein the quick connectors are plug in connectors.

14. The swim ring according to claim 2, wherein the quick connectors are zip fasteners.

15. The swim ring according to claim 2, wherein the quick connectors are hook and loop fasteners.

16. The swim ring according to claim 2, wherein the quick connectors are buttons interacting with button holes.

17. The swim ring according to claim 5, wherein a male plug includes an engagement lug which is deformable upon insertion of the male plug into a female plug receiver, and wherein the engagement lug reaches behind a retaining edge of a recess in the female plug receiver in a elastic manner in a completely inserted end position of the male plug in the female plug receiver.

18. The swim ring according to claim 5, wherein the combined one piece wing side connector includes at least two female plug receivers, a female plug receiver and a male plug, or two male plugs.

19. The swim ring according to claim 6, wherein the combined one piece wing side connector includes at least two female plug receivers, a female plug receiver and a male plug, or two male plugs.

* * * * *